US007487971B2

(12) United States Patent
Angles

(10) Patent No.: US 7,487,971 B2
(45) Date of Patent: Feb. 10, 2009

(54) PORTABLE DART PLAYING FIELD

(76) Inventor: Eric W. Angles, 2843 Crown Ridge Blvd., Columbus, OH (US) 43235

( * ) Notice: Subject to any disclaimer, the term of this patent is extended or adjusted under 35 U.S.C. 154(b) by 0 days.

(21) Appl. No.: 11/381,195

(22) Filed: May 2, 2006

(65) Prior Publication Data

US 2006/0249908 A1 Nov. 9, 2006

Related U.S. Application Data

(60) Provisional application No. 60/677,102, filed on May 3, 2005.

(51) Int. Cl.
*F41J 1/10* (2006.01)
*F41J 3/00* (2006.01)

(52) U.S. Cl. ..... 273/407; 273/408

(58) Field of Classification Search ..... 273/371–377, 273/403–410; 473/160, 195
See application file for complete search history.

(56) References Cited

U.S. PATENT DOCUMENTS

| | | | | | |
|---|---|---|---|---|---|
| 1,996,986 | A * | 4/1935 | Weinberg | 273/400 |
| 2,455,185 | A * | 11/1948 | May | 473/195 |
| 3,501,149 | A * | 3/1970 | Meyer | 273/407 |
| 3,601,406 | A * | 8/1971 | Giusti | 473/160 |
| 3,817,528 | A * | 6/1974 | Stuhler | 273/393 |
| 4,022,472 | A * | 5/1977 | Seals | 273/400 |
| 4,029,318 | A * | 6/1977 | Boss | 273/390 |
| 4,625,974 | A * | 12/1986 | Andrews | 273/407 |
| 4,974,857 | A * | 12/1990 | Beall et al. | 273/371 |
| 5,054,792 | A * | 10/1991 | Danielson | 273/408 |
| 5,280,920 | A * | 1/1994 | Knapper, II | 273/407 |
| 5,553,850 | A * | 9/1996 | Savu et al. | 273/317.2 |
| 5,725,217 | A * | 3/1998 | White | 273/407 |
| 5,967,523 | A | 10/1999 | Brownlee | |
| 6,045,132 | A * | 4/2000 | Giegerich | 273/408 |
| 6,322,461 | B1 | 11/2001 | Walsh | |
| 6,435,512 | B1 | 8/2002 | Beckwith | |
| 6,726,208 | B2 | 4/2004 | Wilkus | |
| 6,793,221 | B2 | 9/2004 | Giegerich | |
| 2004/0140622 | A1 | 7/2004 | Giegerich | |

OTHER PUBLICATIONS

Cyber/Darts, Darts Basics—Rules, Tips, Equipment and Dartboard Measurements, Mar. 28, 2005, 10 pages, http://www.cyberdarts.com/basics/dartsbasics.html.

* cited by examiner

*Primary Examiner*—Mark S Graham

(57) ABSTRACT

A playing field (10) is useful in a game in which objects are thrown at a target by at least one player, such as in a game of darts. The playing field has a vertically-extending planar surface (12) and a horizontal surface (14). The vertically-extending planar surface is adapted on a front face for mounting the target. The horizontal surface, which extends from the front face, has at least one transverse indicium (52) marked thereupon, the transverse indicium positioned parallel to the planar front face. The playing field has a plurality of planar members (18, 20, 26, 28, 30, 32) that are easily assembled and disassembled for transport.

7 Claims, 2 Drawing Sheets

PORTABLE DART PLAYING FIELD

CROSS-REFERENCE TO RELATED APPLICATIONS

This application is a non-provisional of U.S. provisional patent application 60/677,102, filed 3 May 2005, which is incorporated by reference as if fully recited herein.

TECHNICAL FIELD

The present invention relates to a portable device useful in the game of darts. More particularly, the present invention provides a portable playing field for the game of darts, wherein the dart board is mounted at a correct vertical height and a toe line is provided at a correct horizontal distance from the front plane of the dart board.

BACKGROUND OF THE ART

The game of darts is well-known. In playing the game, it is important that the dart board, which is the target for the thrown darts, be mounted at a particular height and that the toe line, that is, the line beyond which the darter throws the darts, is approximately 8 feet from the front plane of the dart board. In fact, the toe line distance varies slightly, depending upon the type of dart used. In a steel-tip dart game, the traditional toe line distance is 2.37 meters, or 7 feet, 9.25 inches. In a soft-tip game, the accepted toe line distance is 8 feet.

Although it is expected that the darter will hit the board with each and every dart thrown, practical experience teaches that such is not the case, particularly when the game is played in association with drinking and merriment. It is, therefore, well-known in the games of darts to not mount the dart board directly on a wall, but instead to place the dart board atop a larger backstop board that provides protection against darts striking the wall.

To enlarge the area of protection and to store the darts when not in use, it is also known in the art to provide a cabinet-like structure, with a pair of doors in hinged relationship to the side edges of the backstop board. When closed, the doors conceal the dartboard and provide an ornamental surface. When opened, they effectively double the protective area provided.

Such a cabinet-like structure adds considerably to the weight that needs to be mounted to a wall, requiring a more substantial means for attaching, and, possibly, a larger hole in the wall.

In many situations, permanent attachment of such a structure to a wall is not feasible. It is also desirable in many of these same situations to provide a complete (and accurately laid out) dart playing area that is portable. For example, one such situation is encountered at a darts tournament, where a number of playing areas are required to facilitate the number of players.

It is therefore an unmet advantage of the prior art to provide a portable dart playing field that positions the dart board at a correct height, provides a backstop board for errant darts and provides a toe line at a correct distance from the dart board.

SUMMARY OF THE INVENTION

This and other features and advantages of the present invention are provided by a playing field for use in a game in which objects are thrown at a target by at least one player.

In an exemplary embodiment, the playing field has a vertically-extending planar surface adapted on a front face for mounting of the target thereupon and a horizontal surface, extending from the front face. The horizontal surface has at least one transverse indicium marked thereupon, the transverse indicium positioned parallel to the planar front face. In such an embodiment, the playing field comprises a plurality of planar members that are easily assembled and disassembled for transport.

The exemplary embodiment is useful in the game of darts, where the vertically-extending planar surface is adapted for mounting a dart board as the target with a center of the dart board located at a height of 68 inches; and the at least one transverse indicium is a toe line.

In the exemplary embodiment, the playing field comprises a plurality of side elements, each side element attached to the vertically-extending planar surface and providing structural stability thereto. Preferably, each side element is hingedly attached to the vertically-extending planar surface.

In some embodiments, the vertically-extending planar surface comprises a first and a second portion, the portions hingedly connected together. IN this and other embodiments, a first and a second of the plurality of side elements are hingedly attached to the first portion of the vertically-extending planar surface, and a third and a fourth of the plurality of side elements are hingedly attached to the second portion of the vertically-extending planar surface.

BRIEF DESCRIPTION OF THE DRAWINGS

In addition to those mentioned above, will become apparent to those skilled in the art from a reading of the following detailed description in conjunction with the accompanying drawings wherein identical reference characters refer to identical parts and in which.

DETAILED DESCRIPTION OF A PREFERRED EMBODIMENT

Figure 1:
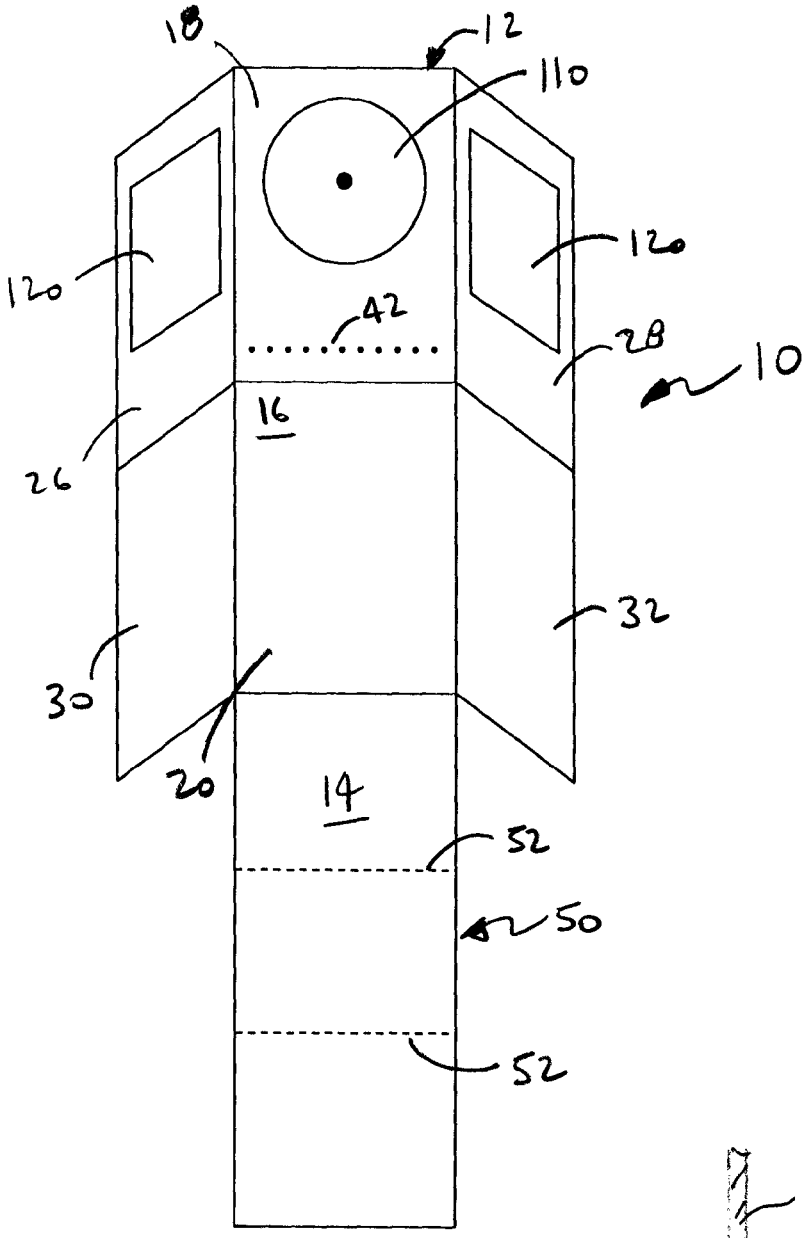
FIG. 1 is a front elevational view of an embodiment of the dart playing field.

FIG. 1 shows an embodiment of the dart playing field 10 of the present invention, assembled for use. In the illustrated embodiment, the playing field 10 comprises a vertically-extending planar member 12 and a horizontally-extending member 14, extending from a front face 16 of the vertically-extending planar surface. The front face 16 is adapted to have a dart board 110 mounted thereupon. In the embodiment illustrated, the vertically-extending planar member 12 comprises two portions 18, 20. In this embodiment, each of the two portions 18, 20, is about 3 feet, 6 inches tall and about 2 feet wide. When joined together along one of the shorter edges, the resulting vertically-extending planar surface 12 is about 7 feet tall and about two feet wide. In a preferred embodiment the portions 18, 20 are joined by one or more hinges 22, placed along one of these shorter edges on each portion. In some embodiments, it may be preferred to provide a means for locking the portions 18, 20 when they are in the planar relationship shown in FIG. 1. Specific orientation of hinges 22 (as well as other hinges used in the device) will be discussed below with reference to FIG. 3.

The preferred placement of the dart board 110 on the playing field 10 is shown in FIG. 1. The conventional diameter of a circular dart board is 18 inches, and the standard rules specify that the board should be mounted with the center of the board at 5 feet, 8 inches above the ground. At a total height of 7 feet, the vertically-extending planar surface will extend about 7 inches above the top of the dart board.

In some embodiments of the present invention a dart board 110 contained in a cabinet (not shown) may be used. In these embodiments the cabinet will be mounted to the front face 16 of the playing surface 10 so that when the cabinet doors are opened the dart board may be used.

Figure 2:
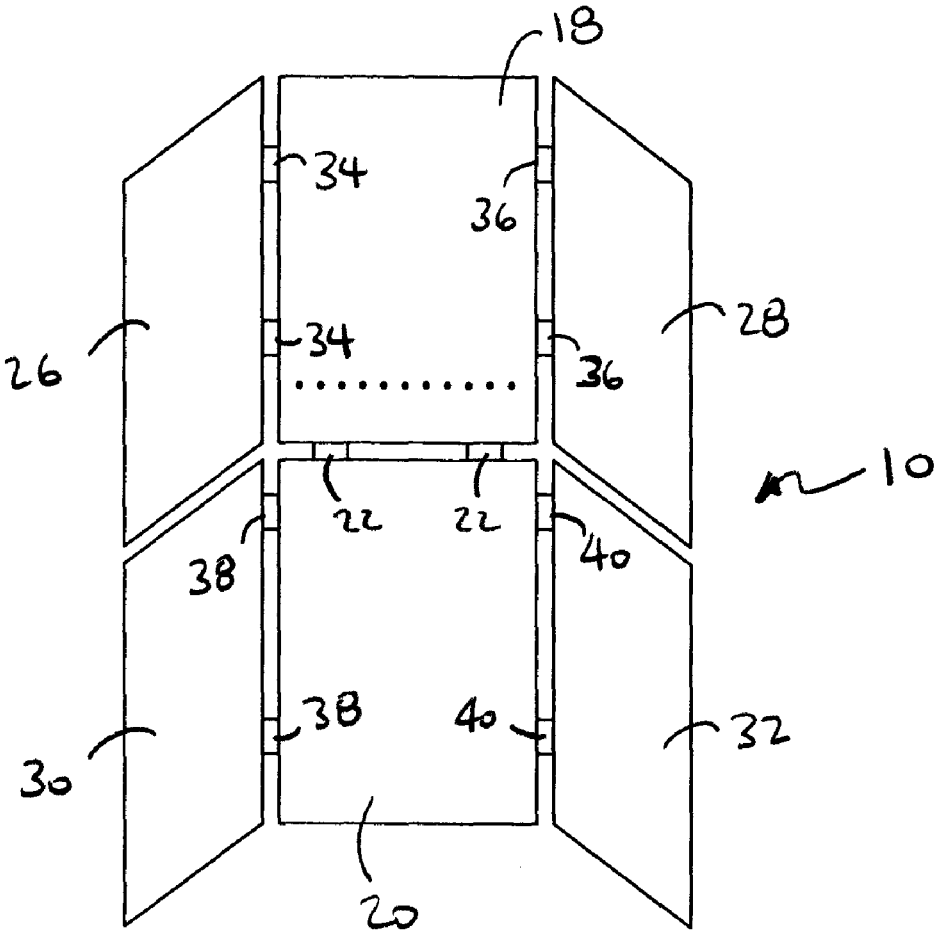
FIG. 2 is a front elevational view of the FIG. 1 embodiment.

In the exemplary embodiment, each of the portions 18, 20 is provided with a further pair of side boards, with side boards 26, 28 provided for portion 18 and side boards 30, 32 provided for portion 20. The respective side boards are preferably 3 feet 6 inches tall and 1 foot wide, so that side boards 26, 28 can fold atop portion 18 and side boards 30, 32 can fold atop portion 20. Each side board is attached, along one of its longer edges to the longer edge of the associated portion. Preferably, this is a hinged attachment that allows the side boards to be angularly positioned relative to the corresponding portion. As shown in FIG. 2, at least one hinge 34 attaches side board 26 to portion 18, at least one hinge 36 attaches side board 28 to portion 18, at least one hinge 38 attaches side board 30 to portion 20, and at least one hinge 40 attaches side board 32 to portion 20. As shown in FIG. 1, a preferred embodiment of the invention may have boards 120 attached to at least one of the side boards 26, 28 for score keeping.

When the playing field 10 is set up for use, the side boards 26, 28, 30, 32 are preferably arranged in an angular relationship to the corresponding portions 18, 20, especially with the angle between a portion and each of its corresponding side boards being in the range of about 120° to about 150°, and preferably about 135°. Preferably, the side boards on each side of the playing field 10 are aligned with each other in a planar relationship, and even more preferably, these side boards are adapted to be locked into that planar relationship with a means for locking, which should be positioned on a rear surface of the side boards. When properly assembled, the portions 18, 20 and side boards 26, 28, 30, 32 form a structurally stable unit that is useful as a dart playing field 10.

The upper portion 18 should be adapted for mounting of the dart board 110.

In a preferred embodiment, a series of holes 42 are drilled in an angular manner into a lower area of the portion 18, each of the holes being sized to slidingly receive a dart, thereby permitting storage thereof, at least while the playing field 10 is deployed for use.

In some embodiments of the invention, a base member 50 is included. The base member 50 may be used to provide additional stability to the assembled playing field. As shown by the embodiment in FIG. 1, in certain of these embodiments the base member 50 may extend away from the front face 16 of the vertically-extending planar surface 12 to define the horizontally-extending surface 14. In such a case, either the base member 50 or an extension thereof may have at least one transverse indicium 52 marked thereupon, the transverse indicium positioned parallel to the planar front face and used as a toe line or "hockey" as it is sometimes referred to in the rules of the game of darts. Because the distance from the plane of the board to the toe line varies, depending upon the type of dart used, a preferred horizontally-extending surface 14 will be able to be associated with the vertically-extending planar surface 12 at a known point, so that at least two of the appropriate toe line distances, that is, 7 feet, 9.25 inches and 8 feet, can be properly designated using the transverse indicia 52.

Figure 3:
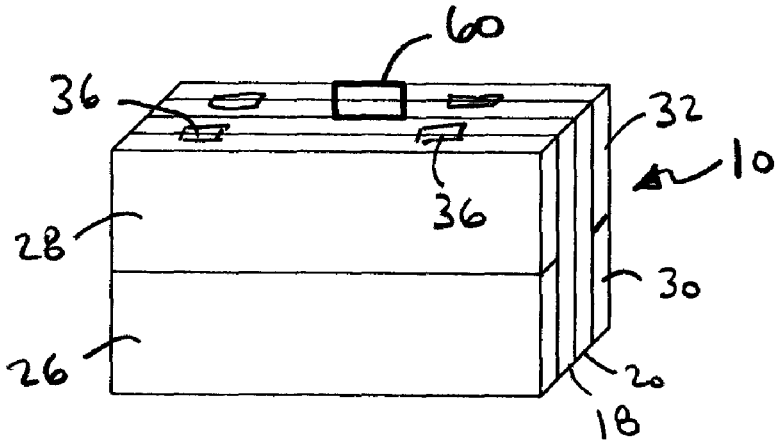
FIG. 3 is a front perspective view of the FIG. 1 embodiment, where the dart playing field has been collapsed and folded for increased portability.

In some embodiments of the invention the playing field 10 is joined together in such a way that the playing field 10 can be collapsed for increased portability and ease of storage when not in use. FIG. 3 shows an embodiment of the invention where the dart playing field 10 has been collapsed and a handle 60 has been attached to one of the portions 18, 20. However, other embodiments of the invention may incorporate other means for carrying the collapsed playing field. Obtaining the folded arrangement of FIG. 3 requires proper orientation of the hinges used. In general, a hinge has a pair of leafs, with each leaf providing a series of knuckles that intermesh to form a barrel, through which a pin is placed. The respective leafs of the hinge are attached to edge surfaces and pivot about an axis defined by the barrel and pin, which are co-axial. In this manner of hinge, the barrel/pin will be positioned on the "inside" of an angle through which the hinge pivots. With this in mind, if a hinge is placed between two planar portions that define a planar surface and if the position of the pin of that hinge is known as being either "above" the surface or "below" the surface, then the relative movement between the planar portions will be known. If the pin is above the surface, then the two portions will fold toward each other, so that the faces of the portions that form the surface will face each other upon folding. On the other hand, if the pin is below the surface, then the two portions will fold away from each other, so that the faces of the portions that form the surface will face away from other upon folding. Using this definition of hinge placement, the folded configuration of the device 10 shown in FIG. 3 is achieved by placing hinges 22 below surface 16 and by placing hinges 34, 36, 38 and 40 above surface 16.

Figure 4:
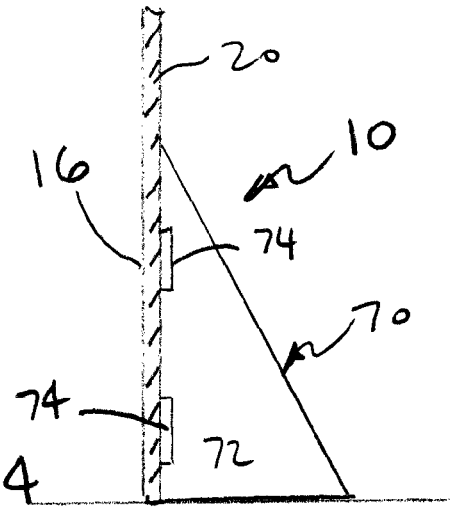
FIG. 4 is a partial side section view of the FIG. 1 embodiment, showing an optional rear support member.

FIG. 4 illustrates a further option that may be useful in some embodiments. In this Figure, which is a partial side sectional view of the lower portion 20, a back support 70 is shown attached to a rear surface of the lower portion. In the embodiment illustrated, the back support 70 comprises a triangular member 72, attached by a pair of hinges 74 to the rear surface. This back support 70 is preferably thin (although structurally sound) and will fold flush against the rear surface, so as to not impede folding of the playing field 10 in the manner shown in FIG. 3. In the folded state of the device, the back support 70 will be positioned between the respective rear surfaces of portions 18 and 20.

While not essential to the use of the playing field 10, materials of construction for the playing field will generally be selected so that darts that strike the playing field instead of the dart board will not be damaged by the contact. In particular, a thrown dart usually strikes with its tip end. Depending upon whether a soft or hard tip dart is used, the material selected should either allow penetration of the tip or deflect the tip away in a non-damaging manner. A material that allows penetration, for example, would be a plywood, or, even preferably, a cork-coated plywood. A deflecting surface, particular for a soft-tip dart would be a plastic material, such as a polystyrene.

Having shown and described a preferred embodiment of the invention, those skilled in the art will realize that many variations and modifications may be made to affect the described invention and still be within the scope of the claimed invention. Thus, many of the elements indicated above may be altered or replaced by different elements which will provide the same result and fall within the spirit of the claimed invention. It is the intention, therefore, to limit the invention only as indicated by the scope of the claims.

What is claimed is:

1. A playing field for use in a game of darts in which darts are thrown at an affixed dart board by at least one player, the playing field adapted to be set on a floor, comprising:

a vertically-extending planar surface adapted on a front face for mounting of a dart board within, the vertically-extending planar surface comprising a first and a second portion, the portions being of substantially the same size, hingedly connected together along an edge, and extending from the floor to an appropriate height for properly affixing a dartboard, a back support hingedly attached to a rear face of the second portion;

a horizontal surface, extending from the front face, the horizontal surface having at least one transverse indicium marked thereupon, the transverse indicium positioned parallel to the planar front face and is the proper distance from the vertical surface for a game of darts;

wherein the playing field comprises a plurality of planar members that are easily assembled and disassembled for transport.

2. The portable playing field of claim 1, wherein:

the vertically-extending planar surface is adapted for mounting a dart board as the target with a center of the dart board located at a height of 68 inches.

3. The portable playing field of claim 1, further comprising:

a plurality of side elements, each side element attached to the vertically-extending planar surface and providing structural stability thereto.

4. The portable playing field of claim 3, wherein:

each side element is hingedly attached to the vertically-extending planar surface.

5. The portable playing field of claim 3, wherein:

a first and a second of the plurality of side elements are hingedly attached to the first portion of the vertically-extending planar surface, and a third and a fourth of the plurality of side elements are hingedly attached to the second portion of the vertically-extending planar surface.

6. The portable playing field of claim 5, wherein:

Each of the plurality of side elements has a length substantially the same as a length of the respective first and second portions and a width that is approximately one-half of a width of the respective first and second portions.

7. The portable playing field of claim 1, wherein:

The vertically-extending planar surface is of sufficient thickness to mount a dart board within, such that the face of the dart board does not protrude significantly past the face of the vertically-extending planar surface.

* * * * *